US006932526B2

(12) United States Patent
Aviles et al.

(10) Patent No.: US 6,932,526 B2
(45) Date of Patent: Aug. 23, 2005

(54) MULTI-STAGE PRE-TRANSFER SUBSTRATE HEATING ASSEMBLY

(75) Inventors: Eilleen R. Aviles, Webster, NY (US); Barry P. Mandel, Fairport, NY (US); Martin Krucinski, Webster, NY (US); Jeffrey J. Folkins, Rochester, NY (US); Keith A. Buddendeck, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 43 days.

(21) Appl. No.: 10/719,398

(22) Filed: Nov. 21, 2003

(65) Prior Publication Data

US 2005/0111896 A1 May 26, 2005

(51) Int. Cl.[7] ..... B41J 25/00; B65H 7/00

(52) U.S. Cl. ..... 400/578; 400/679; 347/101; 347/102; 347/103

(58) Field of Search ..... 347/101, 102, 347/103, 104, 105; 400/579, 630, 631, 679, 400/719, 578

(56) References Cited

U.S. PATENT DOCUMENTS 4,395,036 A * 7/1983 Bergman et al. ..... 271/171
5,372,852 A 12/1994 Titterington et al. ..... 427/288
5,742,315 A * 4/1998 Szlucha et al. ..... 347/102
2004/0075726 A1 * 4/2004 Hirai ..... 347/102
2004/0104990 A1 * 6/2004 Johnson ..... 347/103
2004/0145617 A1 * 7/2004 Nunokawa ..... 347/16

FOREIGN PATENT DOCUMENTS

JP 05104706 A * 4/1993 ..... B41J 2/01
JP 11198362 A * 7/1999 ..... B41J 2/01

OTHER PUBLICATIONS

Machine translation of JP 11-198362 to Suzurucha from Japanese Patent Office website.*

* cited by examiner

*Primary Examiner*—Daniel J. Colilla
(74) *Attorney, Agent, or Firm*—Tallam I. Nguti

(57) ABSTRACT

An ink image producing machine has (a) imaging devices, including at least one ink jet print head and an image receiving station for producing an ink image on a heated substrate; (b) a substrate handling assembly including holding devices for holding supplies of substrates, and transport feeding devices for transporting and feeding substrates in a substrate direction towards the image receiving station; (c) a first substrate heating assembly located upstream of the image receiving station for initially heating each substrate being fed and transported from the holding devices; and (d) a second substrate heating assembly located downstream of the first substrate heating assembly and upstream of said image receiving station, relative to the substrate feeding direction, for controllably re-heating each substrate, initially heated by the first substrate heating assembly, to a desired ink image receiving temperature.

15 Claims, 2 Drawing Sheets

MULTI-STAGE PRE-TRANSFER SUBSTRATE HEATING ASSEMBLY

BACKGROUND AND SUMMARY

This invention relates generally to image producing machines, and more particularly to such a machine having a plurality of image pre-transfer substrate heating assemblies. Such assemblies are particularly useful in a high-speed phase change ink image producing machine or printer.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 5,372,852 issued Dec. 13, 1994 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them the image receiving substrate, and fixing the phase change ink to the substrate.

It has been found that relatively effective image transfer in an ordinary speed (12–32 copies per minute) solid ink printer can be achieved from having the substrate pre-heated or heated prior to image transfer. Conventionally, as disclosed for example in U.S. application Ser. No. 10/320,821, a single stage pre-heater has been used to transfer heat to the substrate prior to the substrate being registered for image transfer. Unfortunately, it has been found that in relatively high speed (40 and more copies per minute) solid ink printers, for example, a single stage heater is tends to transfer insufficient heat or too much heat to the substrate. This is because such machines or printers call for substrates to be transported at the high substrate transport speeds (approximately 1440 mm/sec). This problem is made even worse where the substrate transport speeds are varied between a slow speed and an accelerated.

There is therefore a need for a pre-transfer substrate heating arrangement that is capable of providing just enough heat to substrates at relatively high speed for achieving effective image transfer in a solid ink image producing machine or printer.

In accordance with the present disclosure, there is provided an ink image producing machine that has (a) imaging devices, including at least one ink jet print head and an image receiving station for producing an ink image on a heated substrate; (b) a substrate handling assembly including holding devices for holding supplies of substrates, and transport feeding devices for transporting and feeding substrates in a substrate direction towards the image receiving station; (c) a first substrate heating assembly located upstream of the image receiving station for initially heating each substrate being fed and transported from the holding devices; and (d) a second substrate heating assembly located downstream of the first substrate heating assembly and upstream of said image receiving station, relative to the substrate feeding direction, for controllably re-heating each substrate, initially heated by the first substrate heating assembly, to a desired ink image receiving temperature.

BRIEF DESCRIPTION OF THE DRAWINGS

In the detailed description of the invention presented below, reference is made to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
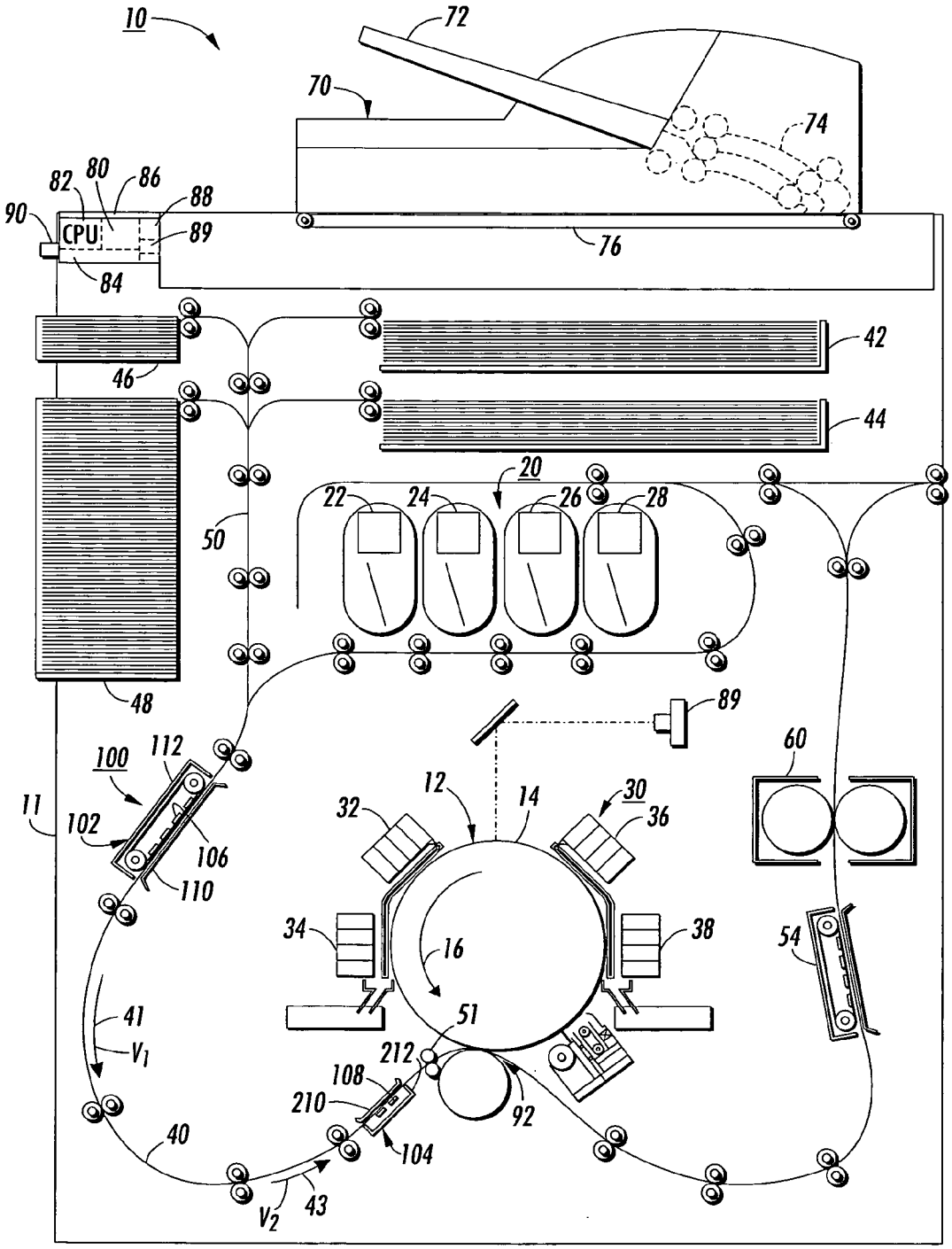
FIG. 1 is a vertical schematic of an exemplary high-speed phase change ink image producing machine or printer including the multi-stage substrate pre-heater assembly of the present invention.

Referring now to FIG. 1, there is illustrated an image producing machine, such as an exemplary high-speed phase change ink image producing machine or printer 10 of the present invention. As illustrated, the machine 10 includes a frame 11 to which are mounted directly or indirectly all the operating subsystems and components thereof as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes melting and control apparatus (not shown in FIG. 1) for melting or phase changing the solid form of the phase change ink into a liquid 20 form, and then supplying the liquid form to a printhead system 30 including at least one printhead assembly 32. Since the phase change ink image producing machine or printer 10 is a high-speed, or high throughput, multicolor image producing machine, the printhead system includes four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources

42, 44, 46, 48, of which supply source 48 for example is a high capacity paper supply or feeder for storing and supplying image receiving substrates in the form of cut sheets for example. The substrate supply and handling system 40 in any case includes a substrate handling system 50 that has the multi-stage substrate pre-heater assembly 100 of the present invention (to be described in detail below). The substrate handling system 50 may also includes a post-transfer, pre-fuser substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid form phase change ink is melted and delivered to the printhead assemblies, pixel placement control is exercised relative to the imaging surface 14 forming a desired image per such image data, a receiving substrates is supplied by anyone of the sources 42, 44, 46, 48 and handled by means 50 in timed registration with image formation on the surface 14, and the image is transferred within the transfer nip or station 92, from the surface 14 onto the receiving substrate for subsequent fusing at fusing device 60.

Figure 2:
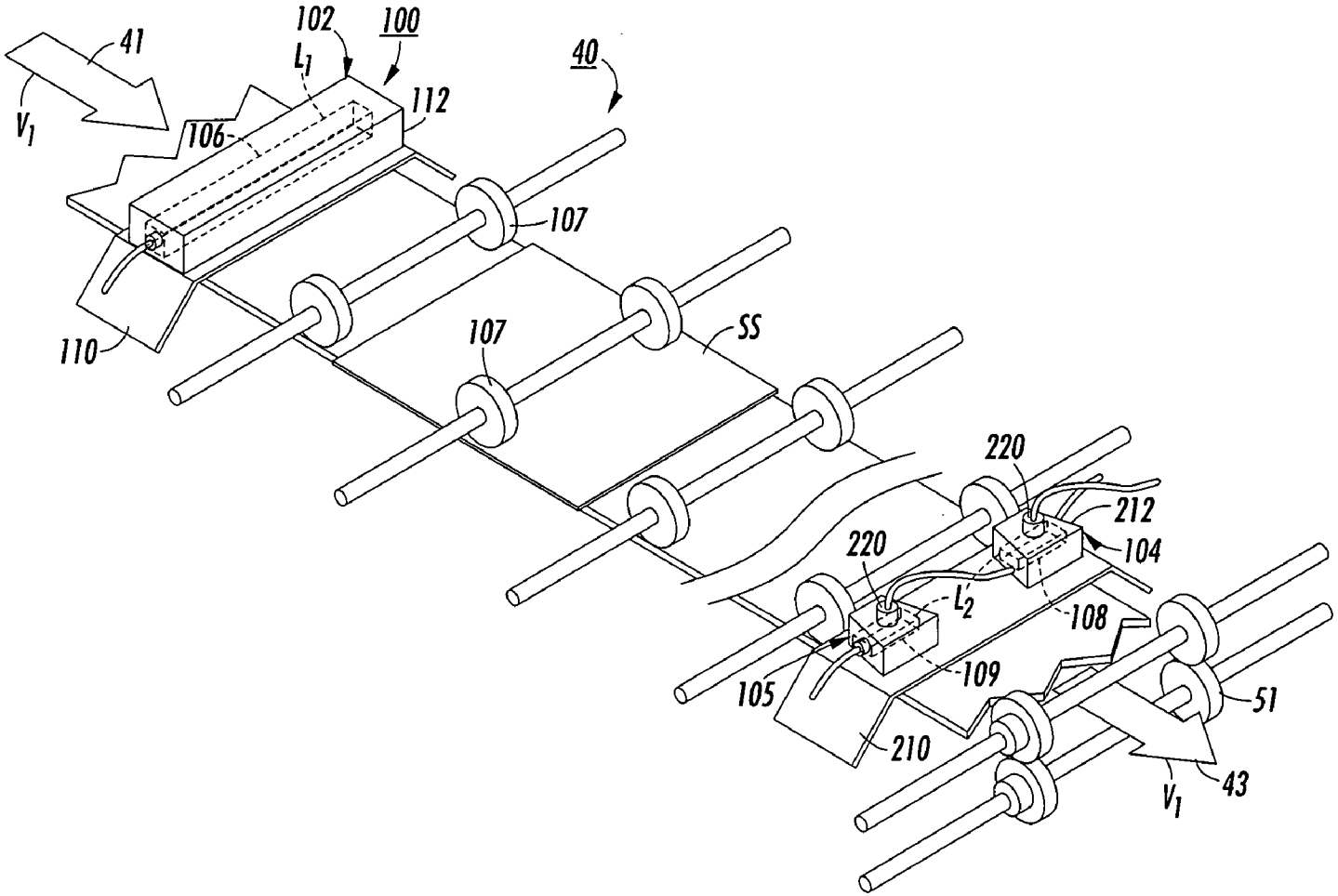
FIG. 2 is an enlarged illustration of the multi-stage substrate pre-heater assembly showing the first full width, and the second partial width pre-heaters in accordance with the present invention.

Referring now to FIGS. 1–2, the substrate handling system 50 includes the multi-stage substrate pre-transfer substrate assembly 100 of the present invention. The multi-stage substrate pre-transfer substrate assembly 100 as further illustrated in greater detail, includes a first substrate heating assembly 102 and a second substrate heating assembly 104, 105. As shown, the substrate handling system 50 includes substrate path guide baffles (not shown) located at the entrance and exit sides respectively of the multi-stage pre-transfer substrate heating assembly 100 of the present invention. As further shown, the first substrate heating assembly 102 is located near the start of the substrate feeding path 40. The first substrate heating assembly 102 is a full-width device spanning the entire width of the substrate feeding path 40, and may for example include a plate-on-plate heater as shown defining a part of the substrate path 40 between two plates 110, 112. The plates 110, 112 may be thermally conductive, and as such can be heated aluminum blocks that heat the substrate SS as the substrate comes into contact with them. Alternatively, this first substrate heating assembly 102 could include a belt-on-belt heater as described for example in U.S. patent application Ser. No. 10/320,821, relevant portions of which are incorporated herein by reference. The first substrate heating assembly 102 as such includes a continuous, full-width heating element 106 having a first length L1 equal to at least a width of each substrate SS, or extending across the substrate path 40 for heating an entire edge to edge width of each substrate SS as it is moved through the first substrate heating assembly 102.

In either case, the substrate handling system 50 in one embodiment is controlled to move the substrate through the first substrate heating assembly 102 at a first relatively slow speed V1 (e.g. a speed of a few hundred mm/sec), in order to provide sufficient dwell time in the heating assembly to fully heat the substrate to a first desired temperature, for example, of at least about 37° C. The substrate handling system 50 then accelerates the substrate from the first substrate heating assembly to a second and relatively higher desired speed V2 (approximately 1440 mm/sec) needed for matching the speeds of other components within the image receiving nip or transfer station 92.

As further shown, the second substrate heating assembly 104, 105 is located downstream of the first substrate heating assembly 102 and upstream of the image receiving or transfer station 92, relative to the substrate feeding direction 41, 43, for controllably re-heating each substrate, initially heated by the first substrate heating assembly 102, and to a desired image receiving temperature Td. The second substrate heating assembly 104 may also include a plate-on-plate heater assembly defining part of the substrate path 40 between two plates 210, 212. The plates 210, 212 may be thermally conductive, and as such can be heated aluminum blocks that heat the substrate as the substrate comes into contact with them. Use of the second substrate heating assembly 104 immediately preceding a substrate registration assembly 51 (as shown) ensures that the substrate is at the proper temperature (generally about 370 degrees) for effective image transfer. The second substrate heating assembly 104 equally may be located downstream or after the substrate registration assembly 51. The second substrate heating assembly 104 as such is necessary because the substrate would have likely cooled off, due for example to contact with unheated elements such as feed rollers 107 in the substrate path 40, following its heating by the upstream first substrate heating assembly 102.

The second substrate heating assembly 104 includes at least one heating device 104, 105 each having a second length L2 that is less than a width of each substrate, and extends across only a portion of the path 40, for heating only a part of an edge to edge width of each substrate as it is moved through the second substrate heating assembly 104, 105. As such, the second substrate heating assembly 104, 105 includes only partial width heating elements 108, 109 positioned to reheat such areas of the substrate that would have come into contact with such feed rollers 107. The second substrate heating assembly 104, 105 thus includes the two heating elements 108, 109 that are spaced from one another in a cross direction to the path 40. In addition, since the substrate has likely not cooled totally, the second substrate heating assembly 104, 105 can be smaller, and the substrate transport speed 43 thereover can be relatively higher.

Thus the first or upstream substrate heating assembly 102 located near the substrate supply source 44, 48 performs the primary substrate heating as the substrate passes through it at a relatively slow speed. Each substrate so heated is then accelerated to a relatively higher and desired image transfer speed across the second substrate heating assembly 104 and across the substrate registration assembly 51, and all prior to image transfer. Thus the second substrate heating assembly is located immediately preceding or upstream of the registration assembly 51 (as shown) or after the registration assembly 51, for providing final and adjustment heating in order to enable effective image transfer. As pointed out above, the second substrate heating assembly can thus be small, and may cover only portions of the width of the substrate path as shown. The second substrate heating assembly 104 also includes temperature sensing and control means 220 connected to the machine controller or ESS 80 and to each heating element 108, 109 for sensing a temperature of the substrate SS and controlling that of the heating elements 108, 109 of the second substrate heating assembly 104, 105.

According to an aspect of the present invention, the substrate handling assembly or system 50 includes speed control means connected to the controller 80 and feed rollers 107 for moving each substrate being fed at the first speed V1 through the first substrate heating assembly 102, and at a second and different speed V2 through the second substrate heating assembly 104. The first speed V1 could be calculated and controlled as a function of a predetermined dwell time for each substrate moving through the first substrate heating assembly 102. The second and different speed V2 can be calculated and controlled as a function of a difference between an actual temperature Ta of the each substrate coming from the first substrate heating assembly 102 and a predetermined desired image receiving temperature Td.

As can be seen, there has been provided an ink image producing machine that has (a) imaging devices, including at least one ink jet print head and an image receiving station for producing an ink image on a heated substrate; (b) a substrate handling assembly including holding devices for holding supplies of substrates, and transport feeding devices for transporting and feeding substrates in a substrate direction towards the image receiving station; (c) a first substrate heating assembly located upstream of the image receiving station for initially heating each substrate being fed and transported from the holding devices; and (d) a second substrate heating assembly located downstream of the first substrate heating assembly and upstream of said image receiving station, relative to the substrate feeding direction, for controllably re-heating each substrate, initially heated by the first substrate heating assembly, to a desired ink image receiving temperature.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink image producing machine comprising:

(a) imaging means, including at least one ink jet print head and an image receiving station for producing an ink image on a heated substrate;

(b) a substrate handling assembly including holding means for holding a supply of substrates, transport feeding means for transporting and feeding substrates in a substrate direction towards said image receiving station, and speed control means for moving said each substrate being fed at a first speed through said first heating assembly and at a second and different speed through said second heating assembly;

(c) a first substrate heating assembly located upstream of said image receiving station for initially heating each substrate being fed and transported from said holding means; and (d) a second substrate heating assembly located downstream of said first substrate heating assembly and upstream of said image receiving station, relative to said substrate feeding direction, for controllably re-heating said each substrate, initially heated by said first substrate heating assembly, to a desired ink image receiving temperature.

2. The ink image producing machine of claim 1, wherein said imaging means includes an intermediate imaging member for temporarily supporting and transferring said ink image onto the heated substrate of said image receiving station.

3. The ink image producing machine of claim 1, wherein said substrate handling assembly includes a substrate registration device mounted upstream of said image receiving station relative to said substrate feeding direction for registering a lead end of said each substrate.

4. The ink image producing machine of claim 1, wherein said first substrate heating assembly includes a continuous, full-width heating element having a first length equal to a width of said each substrate, said first length extending across a path of movement of said each substrate for healing an entire edge to edge width of said each substrate as it is moved through said first heating assembly.

5. The ink image producing machine of claim 1, wherein said second substrate heating assembly includes at least one heating element having a second length less than a width of said each substrate, said second length extending across only a portion of a path of movement of said each substrate for heating only a part of an edge to edge width of said each substrate as it is moved through said second heating assembly.

6. The ink image producing machine of claim 1, wherein said second substrate heating assembly includes temperature sensing and control means connected to said at least one heating element for sensing a temperature of each substrate and controlling a temperature of said second-substrate heating assembly.

7. The ink image producing machine of claim 1, wherein said second and different speed is relatively higher than said first speed.

8. The ink image producing machine of claim 1, wherein said first speed is calculated and controlled as a function of a predetermined dwell time for said each substrate through said first substrate heating assembly.

9. The ink image producing machine of claim 1, wherein said second and different speed is calculated and controlled as a function of a difference between an actual temperature of said each substrate coming from said first heating assembly and a predetermined image receiving temperature.

10. The ink image producing machine of claim 3, wherein said substrate registration device is located downstream of said second substrate heating assembly for heating said each substrate during registration thereof.

11. The ink image producing machine of claim 5, wherein said second heating assembly includes two said at least one heating element spaced from one another in a cross direction to said path of substrate movement.

12. A multi-stage pre-transfer substrate heating assembly in an image producing machine for heating a substrates and adjusting a temperature of such substrate prior to image transfer, the multi-stage pre-transfer substrate heating assembly comprising:

(a) a first substrate heating assembly located upstream of an image transfer and receiving station within the machine for initially heating each substrate being fed to said image transfer and receiving station;

(b) a second substrate heating assembly located downstream of said first substrate heating assembly relative to a substrate feeding direction for controllably reheating said each substrate, initially heated by said first substrate heating assembly, to a desired image receiving temperature; and (c) a substrate handling assembly including speed control means for moving each substrate being heated at a first speed through said first heating assembly and at a second and different speed through said second heating assembly.

13. The multi-stage pre-transfer substrate heating assembly of claim 12, wherein said first substrate heating assembly comprises a plate having a first surface, a second and opposite surface, and a heating element.

14. The multi-stage pre-transfer substrate heating assembly claim 13, wherein said plate is made of a thermally conductive material.

15. The multi-stage pre-transfer substrate heating assembly of claim 13, wherein said plate is made of aluminum.

* * * * *